US006175314B1

(12) United States Patent
Cobley

(10) Patent No.: US 6,175,314 B1
(45) Date of Patent: Jan. 16, 2001

(54) VOICE ANNUNCIATION OF DATA LINK ATC MESSAGES

(75) Inventor: George A. Cobley, Center Point, IA (US)

(73) Assignee: Rockwell Collins, Inc., Cedar Rapids, IA (US)

( * ) Notice: Under 35 U.S.C. 154(b), the term of this patent shall be extended for 0 days.

(21) Appl. No.: 09/257,440

(22) Filed: Feb. 25, 1999

(51) Int. Cl.[7] ..... G08B 21/00

(52) U.S. Cl. ..... 340/945; 340/971; 701/14; 701/120

(58) Field of Search ..... 340/945, 963, 340/971; 701/3, 9, 14, 120; 455/73

(56) References Cited

U.S. PATENT DOCUMENTS 3,922,716 * 11/1975 Arnold ..... 340/971
4,369,425 * 1/1983 Andersen et al. ..... 340/945
5,689,419 * 11/1997 Massat ..... 340/945
5,844,503 * 12/1998 Riley ..... 340/945
5,920,807 * 7/1999 Lemme ..... 340/945

OTHER PUBLICATIONS

DO–219 MOPS by RTCA 1993 See Section 2.2.3, p. 28. See Appendix A See Appendix B.

* cited by examiner

*Primary Examiner*—Brent A. Swarthout
(74) *Attorney, Agent, or Firm*—Nathan O. Jensen; Kyle Eppele; J. P. O'Shaughnessy

(57) ABSTRACT

A system for voice announcing air traffic controller to pilot data link communication messages of a type which are in conformance with predetermined industry standard message formats, the system and method including a voice annunciation to the flight crew of such messages with the aid of a database of predetermined speech files which correspond to predetermined controller pilot data link communication messages. The flight crew is able to select a language, gender, dialect, accent, etc. of the announced voice message so as to provide for enhanced communication of air traffic control messages to the flight crew.

19 Claims, 1 Drawing Sheet

VOICE ANNUNCIATION OF DATA LINK ATC MESSAGES

BACKGROUND OF THE INVENTION

The present invention generally relates to aviation electronics and more particularly relates to data link communication systems and even more particularly relates to controller/pilot data link communication (CPDLC) systems.

In the past, much of the communication between aircraft flight crews and air traffic control (ATC) authorities was done with voice radio. As air traffic increased over time, the increasing demand of ATC/flight crew communications increased pressure on the available radio voice frequencies. One response to this demand for voice radio frequencies was the early system known as ACARS (Aircraft Communications Addressing and Reporting System) in which messages were sent to the flight deck in a digital format and the crew was required to read a display or printed message. The messages at first were primarily information relating to the airline's operations, but over time, messages to and from air traffic control authorities were becoming more and more common on these data link communication systems. In the early days, it was not always necessary to read the messages immediately because of their nature, such as information relating to airline operations, connecting flights, information relating to food and beverages, and other airline operation information. But today, with the air traffic control authorities utilizing data links as a form of communication, it is now much more common for there to be an immediate need to review data link messages in the interest of safety of flight. Over time, the trends have been towards increased messages requiring immediate review by the flight crew. This increase of messages requiring immediate review results in flight crews being required to look down and away from other instruments. This increased "heads down" time is generally not favored by the pilots. Once an aircraft, in the departure mode, leaves the gate area, cockpit activity increases rapidly, and the importance of looking outside the cockpit and to all of the instruments in the cockpit becomes increasingly critical. As a result, data messages requiring immediate attention by the flight crew may detract from the safety of flight.

Consequently, there exists a need for improved data link communication systems which provide for enhanced safety of flight.

SUMMARY OF THE INVENTION

It is an object of the present invention to provide for increased safety of flight.

It is a feature of the present invention to include on-board translation of coded ATC messages.

It is an advantage of the present invention to provide, easier to interpret, verbal messages to replace coded messages.

It is another feature of the present invention to include aural annunciation of such verbal messages.

It is yet another advantage of the present invention to provide valuable ATC messages while concomitantly reducing the requirement for heads-down time.

It is yet another feature of the present invention to provide for translation of coded messages into varying languages depending upon a flight crew preference.

It is still yet another advantage of the present invention to reduce the risk of miscommunication caused by limited translation skills on either the ATC authorities or the flight crew.

The present invention is a method and apparatus for providing aural annunciation of ATC messages which is designed to satisfy the aforementioned needs, provide the previously-stated objects, include the above-listed features and achieve the already articulated advantages. The invention is carried out in a "head down-less" system, in the sense that the requirement for flight crews to look down and away from the cockpit instrumentation panel to read data link messages is lessened. Accordingly, the present invention is a system for providing air traffic control information to a flight crew member comprising: means for storing a plurality of predetermined message segments; a means for comparing messages received on an aircraft from an air traffic controller with said predetermined message segments and generating a format confirmed message in response thereto; means for storing a plurality of speech files; means for generating a selection signal in response to predetermined message characteristics; and, means for providing a speech file corresponding to said format confirmed message and further in response to said predetermined message characteristic.

BRIEF DESCRIPTION OF THE DRAWINGS

The invention may be more fully understood by reading the following description of the preferred embodiments of the invention in conjunction with the appended drawings wherein.

DESCRIPTION OF THE PREFERRED EMBODIMENT

Figure 1:
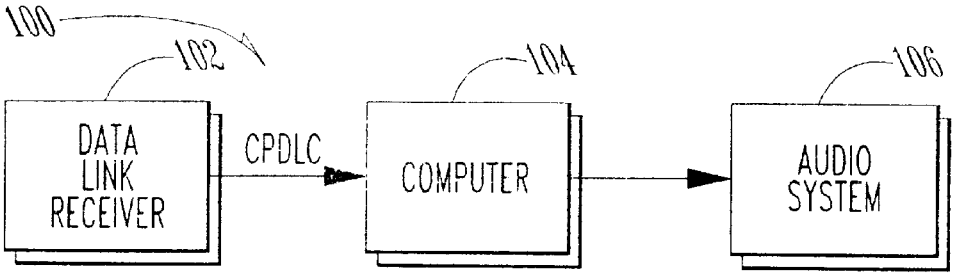
FIG. 1 is a simplified block diagram of the present invention disposed in its intended environment between a data link receiver and an audio system.

Now referring to the drawings, wherein like numerals refer to like matter throughout, and more particularly to FIG. 1, there is shown a system, of the present invention, generally designated 100 which includes a data link receiver 102, which is well known in the art. These data link receivers are commercially available from various avionics manufacturers. These data link receivers are manufactured in accordance with standards set by associations of airlines and other interested entities. One association is the Aeronautical Radio, Inc., which is generally known in the industry as ARINC. The Airline Electronics Engineering Committee (AEEC) also sets characteristics and specifications. ARINC often provides staff and facilities for Subcommittees under AEEC. These documents are often referred to as "ARINC" characteristics and specifications. Similar standard setting bodies are The International Civil Aviation Organization under the United Nations, which is known as ICAO, and RTCA, Inc., which is generally known as the RTCA.

ICAO has created internationally accepted Standards and Recommended Practices (SARPs) that are to assure interoperability on data link systems on a worldwide basis. These standards are a result of work by the AEEC and RTCA.

RTCA has promulgated minimum operational performance standards for ATC two-way data link communications under the designation of RTCA DO-219. These standards are well known to those skilled in the art of data link communications. DO-219 presents requirements for two-way data link (TWDL) communication services. TWDL services include pre-departure clearance, clearances, reports, and requests. Additionally, DO-219 sets forth a complete ATC two-way data link communication message set which sets forth in detail the format of ATC messages and detailed requirements about individual components of the ATC message format, such as message attributes relating to urgency, alerting, response and recall. Additionally, DO-219 includes standardized data structures used in ATC two-way data link communications, which include many pre-established "words" which are assigned to have predetermined spellings and predetermined meanings. For example, "altitudeflightlevel" is a data structure used in ATC two-way data link communications which is established by the RTCA DO-219 to specify the altitude above mean sea level obtained by setting the aircraft altimeter to 29.92 inches of mercury and is expressed in levels of flight in 100-foot increments. Similarly, "altitudeflightlevelmetric" is another standardized data structure for ATC two-way data link communications which has been established by DO-219 to specify the altitude above mean sea level obtained by setting the aircraft altimeter to 1013.2 hectopascals, which is expressed in levels of flight in 10 meter increments. The list of standardized data structures used in the ATC two-way data link communication abstract syntax as promulgated by the RTCA is an extensive list which addresses and standardizes ATC communications that may be expected for many different types of aircraft, different geographic locations, etc. These data structures or words are to be transmitted between the Air Traffic Control and the pilot, along with associated numerical information with the use of the data link radios 102.

One aspect of the present invention includes a method and structure for translating these Controller Pilot Data Link Communications (CPDLC), which are encoded for RTCA DO-219, into spoken messages. This translation would be implemented in the present invention by computer 104 which receives the CPDLC standard messages and generates a voice signal which is then provided to an audio system 106. Computer 104 is shown herein as a separate computer disposed between data link receiver 102 and audio system 106. This is a conceptual depiction of the function of computer 104. In actual commercial embodiments, the computer 104 may be incorporated into the data link receiver 102, the audio system 106, or other avionics normally connected to the receiver not shown; i.e. FMS. The decision to keep computer 104 as a stand-alone device or incorporate it into other equipment on board the aircraft, such as receiver 102 or audio system 106, is a matter of designer's choice, which will be impacted by several factors, including the type of data link receiver 102 on board the aircraft, the type of aircraft, and the type and content of the audio system 106. The processing necessary for computer 104 may be shared by existing processors in data link receiver 102 or audio system 106, or dedicated processors may be utilized as well. The details of the interconnection between data link receiver 102, computer 104, and audio system 106 are, therefore, widely varied and would be easily generated to fit any particular situation by persons skilled in the art.

Figure 2:
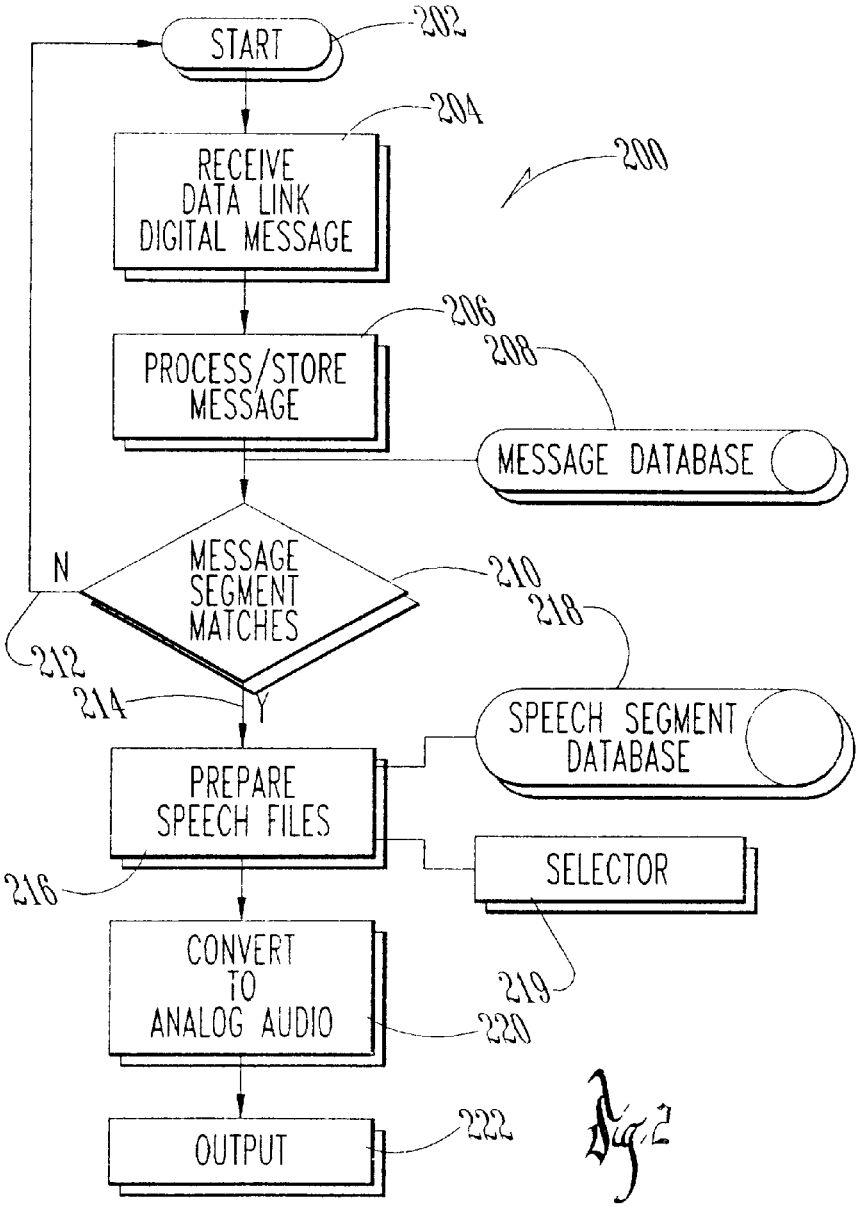
FIG. 2 is a flow diagram of the method of the present invention.

Now referring to FIG. 2, there is shown a simplified flow diagram of a method of the present invention, generally designated 200, which may be implemented by computer 104 to receive CPDL communications from data link receiver 102 and provide audio signals to audio system 106 (FIG. 1). Method 200 can follow the following steps: the process is begun at start 202 and proceeds to step 204, which relates to receiving data link digital messages. This step would be signified in FIG. 1 by the arrow between receiver 102 and computer 104. The next step, step 206, is to process and store the message received in step 204. A database of messages 208 is included. The database 208 includes a list of the standardized CPDLC messages in accordance with RTCA DO-219. The next step is to determine if a message received under 204 and stored under 206 matches a message segment in database 208. If no message segments match, then in accordance with line 212, the process 200 returns to the start position and is begun again. Alternatively, one could select an option to generate a message, such as "Data Link Message received" and then go to 220. However, if a match occurs, then in accordance with the line 214, the process 200 continues. The next step, as shown by step 216, is to prepare speech files for the matched messages. This step 216 of preparing speech files includes additional information, such as access to the speech segment database 218, which includes a list of digital messages in predetermined formats, such as .WAV files. The database would include speech segments for the messages in message database 208, but would include various versions of each message for different languages, different announcer characteristics, such as gender, or even regional accents. Additionally, the step 216 would need to incorporate input from a selector 219, which would provide the pilot or flight crew's preferred format of speech files to be heard. For example, a female pilot from the United Kingdom may select a female voice, the English language, and an additional setting for further customization to accents and dialects, as would be more commonly spoken in the United Kingdom, as opposed to the U.S.A. This step 216 could be also performed through a process of selecting a predetermined language and then processing the chosen speech segment by a voice processor which converts male to female, or otherwise adjusts the speed or other characteristics of the speech message. Depending on the size of database available, a combination of individually stored variations or real time processing of variations of base speech segments could be utilized. The next step of process 200 is to convert these speech segment files, which were prepared in 216, into analog audio signals as shown by step 220. This step could be performed by well-known and generally available software and apparatus for performing this function. Finally, these analog audio signals are output in accordance with block 222 for use by an audio system 106 (FIG. 1).

It is thought that the method and apparatus of the present invention will be understood from the foregoing description and that it will be apparent that various changes may be made in the form, construction, steps and arrangement of the parts and steps thereof, without departing from the spirit and scope of the invention or sacrificing all of their material advantages. The form herein described being a preferred or exemplary embodiment thereof.

I claim:

1. An air traffic control system comprising:

a message database of predetermined message segments relating to air traffic control information;

a comparator for comparing a message, received on an aircraft from an air traffic controller, with content of said message database and providing in response thereto a format confirmed message;

a speech database of a plurality of speech files;

an input selector for providing a signal which is representative of a selection made by a flight crew member relating to predetermined voice characteristics; and, a speech file provider for providing a speech file from said speech database which provides information relating to said format confirmed message and further in response to said signal which is representative of said selection made by said flight crew member.

2. An air traffic control system of claim 1 wherein said comparator is a microprocessor.

3. An air traffic control system of claim 2 wherein said speech file provider is said microprocessor.

4. An air traffic control system of claim 3 further comprising a data link receiver for receiving messages transmitted from an air traffic controller.

5. An air traffic control system of claim 4 wherein said speech database is a database of analog speech files.

6. An air traffic control system of claim 4 wherein said speech database is a database of digital speech files.

7. An air traffic control system of claim 6 further including a digital to analog converter for converting one of said plurality of digital speech files to an analog audio signal.

8. An air traffic control system of claim 7 wherein said predetermined voice characteristic is a language identifier.

9. An air traffic control system of claim 8 wherein said predetermined voice characteristic further comprises a gender identifier.

10. A system for providing air traffic control information to a flight crew member comprising:

means for storing a plurality of predetermined message segments;

a means for comparing messages received on an aircraft from an air traffic controller with said predetermined message segments and generating a format confirmed message in response thereto;

means for storing a plurality of speech files;

means for generating a selection signal in response to a selection made by a flight crew member relating to predetermined message characteristics; and, means for providing a speech file corresponding to said format confirmed message and further in response to said predetermined message characteristic.

11. A system of claim 10 wherein said means for comparing is a microprocessor.

12. A system of claim 11 further comprising means for receiving data link messages from an air traffic controller.

13. A system of claim 12 wherein said microprocessor is a component of said means for receiving data link messages.

14. A system of claim 12 wherein said microprocessor is a component of an audio panel disposed on an aircraft.

15. A method of providing air traffic control messages to a member of a flight crew comprising the steps of:

receiving on board an aircraft a data link message from air traffic authorities;

providing a database of predetermined messages which are in accordance with predetermined industry-based characteristics;

determining if a data link message received matches a predetermined message in said message database;

providing a speech file for a data link message received which matches with a predetermined message in said message database where the speech file is chosen from a database of predetermined speech segments wherein the selection of speech segments is in response to a predetermined message characteristic provided by a flight crew member; and, providing a signal to an audio system on said aircraft for voice announcement of said received message to a flight crew member.

16. A method of claim 15 wherein said predetermined message characteristics relate to a gender characteristic of a preferred voice announcement.

17. A method of claim 16 wherein said predetermined message characteristics relate to a nationality characteristic of a preferred voice announcement.

18. A method of claim 17 wherein said predetermined message characteristics relate to a language characteristic of a preferred voice announcement.

19. A method of claim 18 wherein said predetermined message characteristics relate to a regional dialect characteristic of a preferred voice announcement.

* * * * *